US007862141B2

(12) United States Patent
Hayashi et al.

(10) Patent No.: US 7,862,141 B2
(45) Date of Patent: Jan. 4, 2011

(54) LIQUID-DISCHARGE-FAILURE DETECTING APPARATUS AND INKJET RECORDING APPARATUS

(75) Inventors: Hirotaka Hayashi, Aichi (JP); Kazumasa Ito, Gifu (JP)

(73) Assignee: Ricoh Elemex Corporation, Nagoya (JP)

( * ) Notice: Subject to any disclaimer, the term of this patent is extended or adjusted under 35 U.S.C. 154(b) by 358 days.

(21) Appl. No.: 12/172,743

(22) Filed: Jul. 14, 2008

(65) Prior Publication Data

US 2010/0007686 A1 Jan. 14, 2010

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 4,510,504 A 4/1985 Tamai et al.
2006/0158477 A1* 7/2006 Kusakari et al. ..... 347/19

FOREIGN PATENT DOCUMENTS

EP 0 110 634 A2 6/1984
EP 0 671 272 A2 9/1995
JP 2000-280461 A 10/2000

* cited by examiner

*Primary Examiner*—Julian D Huffman
(74) *Attorney, Agent, or Firm*—Foley & Lardner LLP

(57) ABSTRACT

A light-emitting element emits a beam onto a droplet discharged from a nozzle from a direction opposite to a direction of discharge of the droplet. A light-receiving element receives a scattered light generated by scattering of the beam by the droplet. Finally, a failure detecting unit detects a liquid discharge failure from data of the scattered light received by the light-receiving element.

15 Claims, 8 Drawing Sheets

LIQUID-DISCHARGE-FAILURE DETECTING APPARATUS AND INKJET RECORDING APPARATUS

CROSS-REFERENCE TO RELATED APPLICATIONS

The present document incorporates by reference the entire contents of Japanese applications, 2007-005363 filed in Japan on Jan. 15, 2007 and 2007-011578 filed in Japan on Jan. 22, 2007.

BACKGROUND OF THE INVENTION

1. Field of the Invention

The present invention relates to a technology for detecting a liquid discharge failure in an inkjet recording apparatus.

2. Description of the Related Art

A typical inkjet recording apparatus includes an inkjet head having minute nozzles that discharge minute ink droplets. The inkjet recording apparatus records an image on a recording medium, such as a sheet of paper, by discharging ink droplets from the inkjet head while relatively moving the inkjet head with respect to the recording medium. The inkjet recording apparatus is widely used because of its advantages including high speed operation, low noise, various types of recording media that can be employed, and ability to perform color printing.

However, the inkjet recording apparatus has drawbacks due to the smallness of the nozzles. For example, the ink in the nozzles easily dries when the recording apparatus is not in operation, dust such as paper dust attaches to the nozzles when they are moist with the ink, or air enters into the nozzles. These drawbacks can cause ink discharge failure. Such ink discharge failure can include non-discharge of the ink, discharge of the ink in a wrong direction, and non-desired size of the ink droplet. As a result, a dead dot or a white line is left on the recording medium, resulting in low image quality.

To overcome such disadvantages, a technology for improving the image quality is disclosed in Japanese Patent Application Laid-open No. 2000-280461. More specifically, a light-emitting element emits a laser light to a light-receiving element in a direction perpendicular to a line on which an inkjet head moves over a recording medium, the inkjet head moves in a main printing direction without any recording medium fed in the inkjet recording apparatus, and the inkjet head discharges an ink droplet toward an optical axis of the laser light. A virtual landing spot is obtained by optically detecting the ink droplet, and a timing of discharging the ink is corrected based on the virtual landing spot.

However, with the technology disclosed in Japanese Patent Application Laid-open No. 2000-280461, only the misalignment of the ink discharge in parallel with the main printing direction can be detected and corrected. In general, a recording error is more visible with the misalignment in parallel with the laser light than the recording error with the misalignment in parallel with the main printing direction, and therefore it is more practical to correct the misalignment in parallel with the laser light.

SUMMARY OF THE INVENTION

It is an object of the present invention to at least partially solve the problems in the conventional technology.

According to an aspect of the present invention, there is provided a liquid-discharge-failure detecting apparatus that detects a liquid discharge failure of a nozzle being arranged on an inkjet head surface and discharging droplets of a liquid. The liquid-discharge-failure detecting apparatus includes a light-emitting element that emits a beam onto a droplet discharged from the nozzle from a direction opposite to a direction of discharge of the droplet; a light-receiving element that receives a scattered light generated by scattering of the beam by the droplet; and a failure detecting unit that detects the liquid discharge failure from data of the scattered light received by the light-receiving element.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
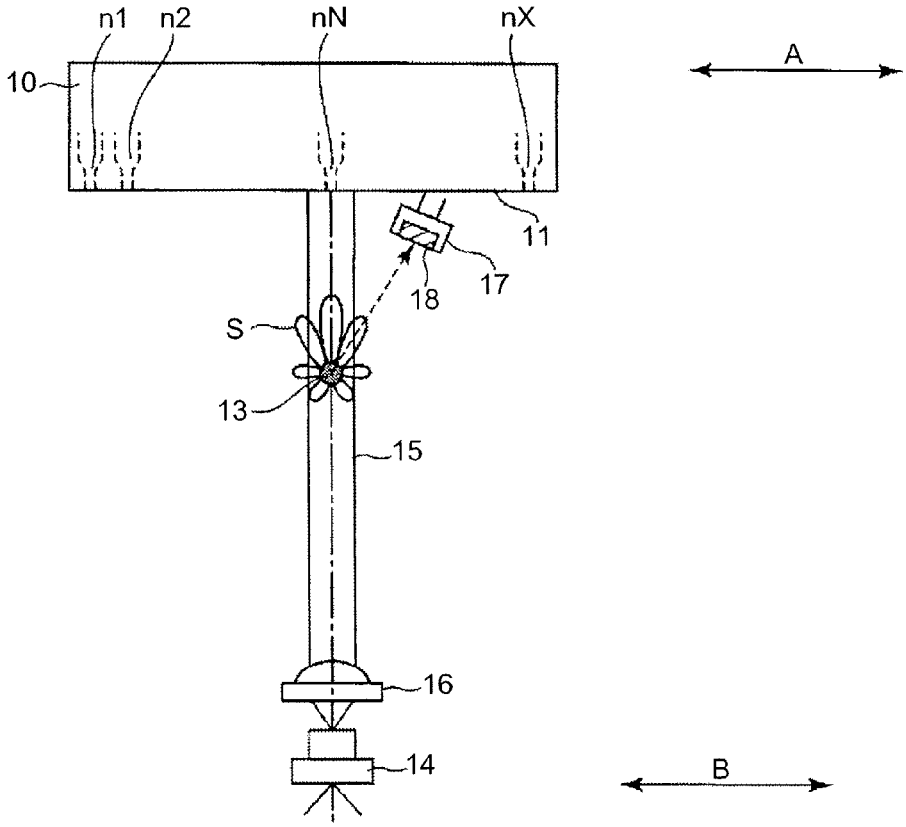
FIG. 1 is a schematic diagram of a liquid-discharge-failure detecting apparatus according to a first embodiment of the present invention incorporated in an inkjet recording apparatus.

FIG. 1 is a schematic diagram of a liquid-discharge-failure detecting apparatus according to a first embodiment of the present invention incorporated in an inkjet recording apparatus. The inkjet recording apparatus includes an inkjet head 10 having an inkjet head surface 11 facing down. A plurality of nozzles n1, n2, . . . , nN, and nX are linearly arranged in a one-dimensional nozzle array along the inkjet head surface 11. Although only one nozzle array has been shown in FIG. 1, four nozzle arrays in yellow, magenta, cyan, and black, can be arranged in parallel with one another along the inkjet head surface 11. The nozzles n1, n2, . . . , nN, . . . , and nX discharge ink droplets downward.

The liquid-discharge-failure detecting apparatus includes a light-emitting element 14 and a collimating lens 16 arranged below the inkjet head surface 11 at a certain distance. The light-emitting element 14 is, for example, a laser diode. The collimating lens 16 collimates a laser light emitted by the light-emitting element 14 to form a beam 15. The beam 15 is emitted from a direction opposite to a direction of discharge of the droplet. In the first embodiment, the beam 15 is emitted upward.

The liquid-discharge-failure detecting apparatus further includes a light-receiving element 17, such as a photodiode, arranged off from the beam 15 with a light-receiving surface 18 of the light-receiving element 17 facing in the direction of discharge of the droplet, i.e., facing down. The light-receiving element 17 is preferably as close to the beam 15 and the inkjet head surface 11 as possible. In this manner, the light-receiving element 17 receives an intense forward-scattered light with a high signal-to-noise ratio (SNR), resulting in an efficient detection.

Ink droplets are discharged from the nozzle nN onto the beam 15 to generate scattered lights S, which are received by the light-receiving element 17, and it is determined whether there is any liquid discharge failure based on data of the scattered lights S received by the light-receiving element 17.

Figure 2:
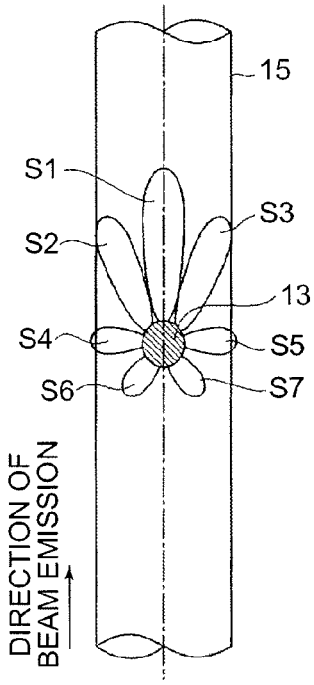
FIG. 2 is a schematic diagram for explaining generation of scattered lights using the liquid-discharge-failure detecting apparatus.

FIG. 2 is a schematic diagram for explaining generation of the scattered lights S when an ink droplet 13 is discharged onto the beam 15. When the ink droplet 13 is discharged onto the beam 15, the scattered lights S including scattered lights S1, S2, S3, S4, S5, S6, and S7 are generated. Optical intensities of the scattered lights S are expressed as S1>S2=S3>S4=S5>S6=S7. The scattered light S1, which is a forward-scattered light in a direction of emission of the beam 15, is most intense among the scattered lights S.

Figure 3:
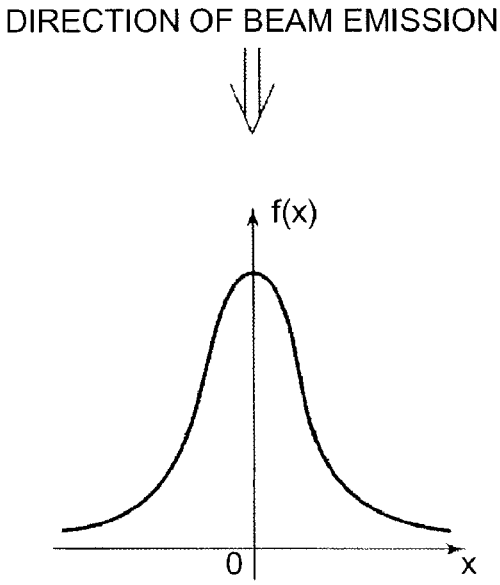
FIG. 3 is a graph of optical intensity of a beam that generates the scattered lights.

FIG. 3 is a graph of optical intensity of the beam 15. The curve represents a Gaussian distribution. In other words, the optical intensity is highest at the center of the beam 15, and it decreases toward the circumference of the beam 15.

After performing a detecting process on a single nozzle nN, the beam 15 is relatively moved with respect to the inkjet head surface 11 in parallel with the nozzle array to perform the detecting process of droplet from a next nozzle n(N+1). In other words, as shown in FIG. 1, the light-emitting element 14 and the collimating lens 16 are moved with respect to the inkjet head 10 in a direction indicated by an arrow B to perform the detecting process on the other nozzles n1, n2, . . . , and nX. Alternatively, the light-emitting element 14 and the collimating lens 16 can be fixed and the inkjet head 10 can be configured to move in directions indicated by an arrow A.

Figure 4:
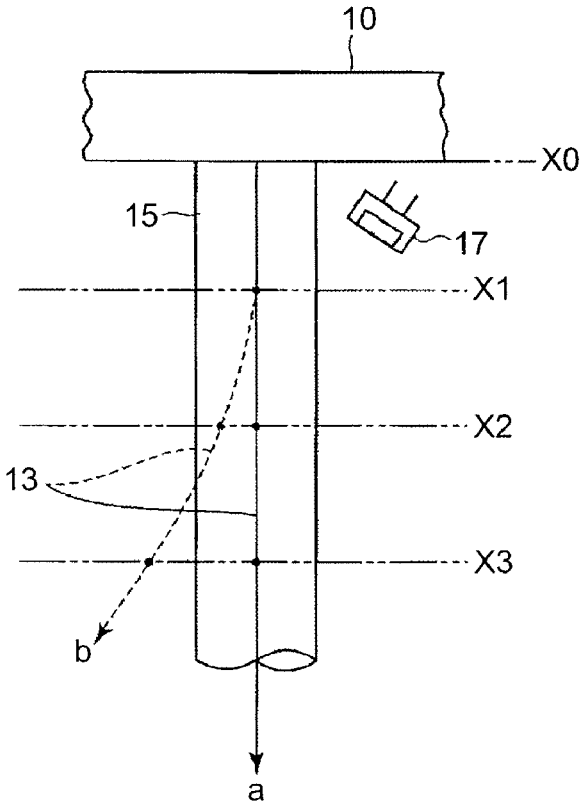
FIG. 4 is a schematic diagram for explaining how to determine whether an ink droplet is correctly discharged.
Figure 5A:
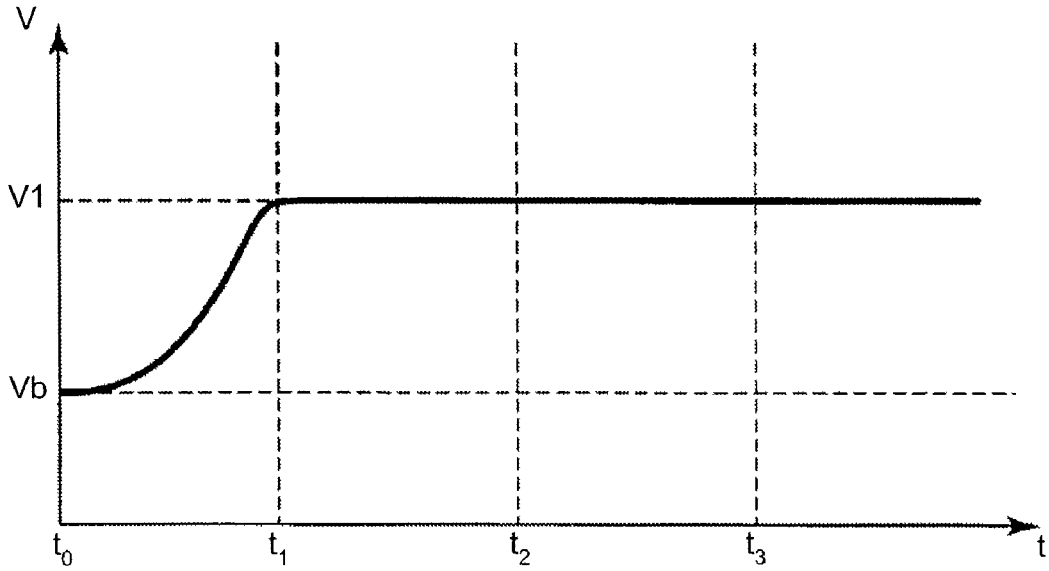
FIG. 5A is a graph of optical power received by a light-receiving element shown in FIG. 1 when the ink droplet is correctly discharged.

FIG. 4 is a schematic diagram for explaining how to determine whether an ink droplet is correctly discharged. A correctly discharged ink droplet traces an arrow a, and an incorrectly discharged ink droplet traces a dotted arrow b. FIG. 5A is a graph of optical power received by the light-receiving element 17 when the ink droplet is correctly discharged, and FIG. 5B is a graph of the optical power when the ink droplet is incorrectly discharged.

Assume that the ink droplet 13 is discharged from a point X0 at time $t_0$. At this time, a certain level of voltage Vb is measured due to an external disturbing light and the like. The ink droplet 13 passes a point X1, which is lower than the light-receiving element 17, at time $t_1$. At X1, the light-receiving element 17 receives a forward-scattered light from the ink droplet 13, and therefore the optical power increases as shown in FIG. 5A. A voltage level at X1 is assumed to be V1. When the ink droplet 13 is correctly discharged, it passes through the center of the beam 15, where the optical intensity is highest, and therefore the voltage level of the scattered light received by the light-receiving element 17 remains V1 even at lower points X2 and X3.

Figure 5B:
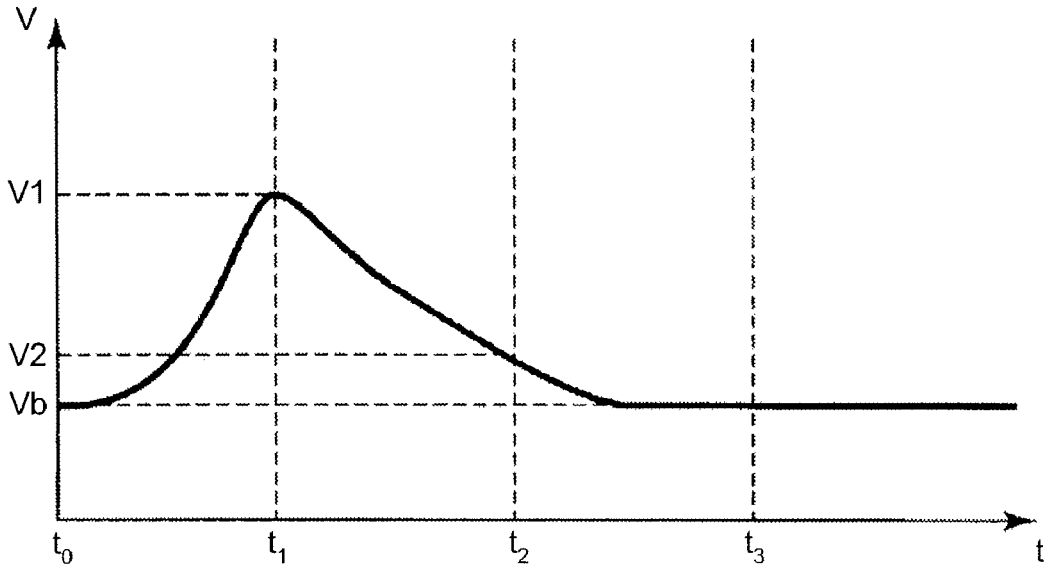
FIG. 5B is a graph of the optical power received by the light-receiving element when the ink droplet is not correctly discharged.

On the contrary, a curve of the voltage level when the trace of the ink droplet 13 bends from X1 in a direction parallel with the nozzle array is shown in FIG. 5B. The voltage level is same as the correctly discharged droplet at X1. However, the ink droplet 13 departs from the center of the beam 15 before it reaches X2, and the optical power decreases accordingly. At X3, the ink droplet 13 is off from the beam 15, and therefore the optical power returns to Vb.

Although detection of the trace bending in parallel with the nozzle array is introduced herein, the liquid-discharge-failure detecting apparatus according to the first embodiment is capable of detecting a trace bending in any direction, such as a trace bending at a right angle to the nozzle array and a spiral trace, based on decrease of the optical power received by the light-receiving element 17. For example, when the ink droplet 13 is off from the beam 15, the optical power is low or null. Moreover, with the distribution of the optical intensity of the beam 15, misalignment of the ink droplet 13 from the center of the beam 15 can be calculated from the optical power.

The liquid-discharge-failure detecting apparatus can be configured to discharge liquids other than ink, such as a clear liquid or a cleaning solution in the detecting process. In this manner, stains by scattered droplets can be prevented.

Figure 6:
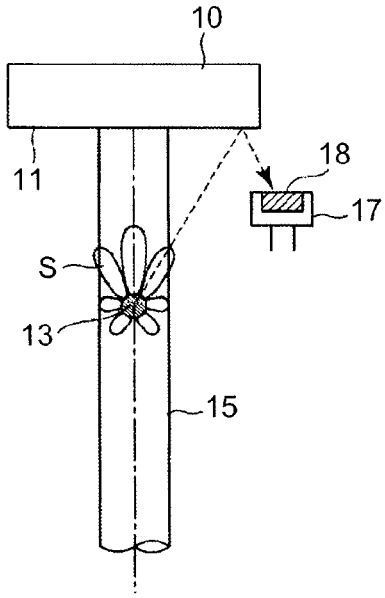
FIG. 6 is a schematic diagram of a liquid-discharge-failure detecting apparatus according to a second embodiment of the present invention incorporated in an inkjet recording apparatus.

FIG. 6 is a schematic diagram of a liquid-discharge-failure detecting apparatus according to a second embodiment of the present invention incorporated in an inkjet recording apparatus. The light-receiving element 17 is arranged with the light-receiving surface 18 facing the inkjet head surface 11. The inkjet head surface 11 is provided with a reflective coating. When the ink droplet 13 is discharged onto the beam 15, the intense forward-scattered light is reflected by the inkjet head surface 11 and then received by the light-receiving surface 18.

Figure 7:
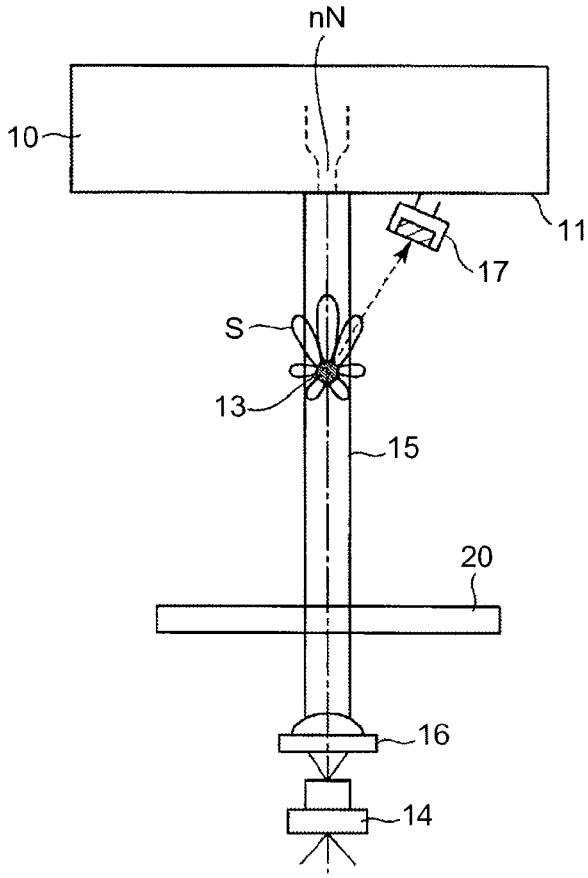
FIG. 7 is a schematic diagram of a liquid-discharge-failure detecting apparatus according to a third embodiment of the present invention incorporated in an inkjet recording apparatus.

FIG. 7 is a schematic diagram of a liquid-discharge-failure detecting apparatus according to a third embodiment of the present invention incorporated in an inkjet recording apparatus. The liquid-discharge-failure detecting apparatus includes a light-transmissive member 20 arranged between the inkjet head surface 11 and the collimating lens 16. The light-transmissive member 20 is, for example, a transparent glass plate, so that allows passage of the beam 15 emitted by the light-emitting element 14 and collimated by the collimating lens 16. The liquid-discharge-failure detecting apparatus further includes a cleaning unit (not shown) that cleans the light-transmissive member 20 before proceeding to checking the next nozzle.

While the beam 15 passes through the light-transmissive member 20, the ink droplet 13 discharged from the nozzle nN falls on the light-transmissive member 20 instead of falling on the collimating lens 16 the light-emitting element 14. In this manner, the light-transmissive member 20 protects the collimating lens 16 and the light-emitting element 14 from stains by the ink droplet 13.

According to the third embodiment, the cleaning unit cleans the light-transmissive member 20, for example, by operating a wiper, thereby preventing degradation of transmittance of the light-transmissive member 20 due to the ink droplet 13 and retaining efficiency of the light-transmissive member 20. However, the light-transmissive member 20 is not absolutely necessary. Instead, for example, the light-transmissive member 20 can be tilted so that the ink droplet 13 on the light-transmissive member 20 flows down by gravity and automatically falls into a waste tank or the like. In this manner, the light-transmissive member 20 remains clean.

Figure 8:
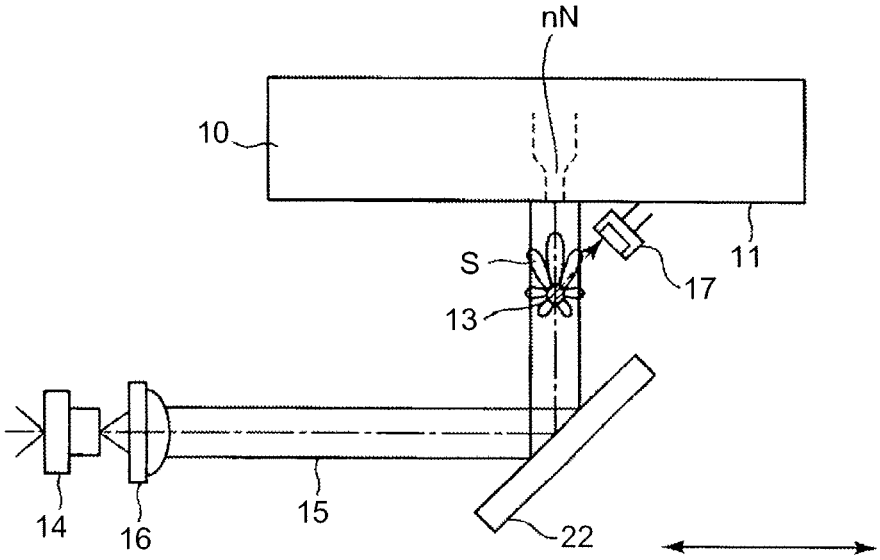
FIG. 8 is a schematic diagram of a liquid-discharge-failure detecting apparatus according to a fourth embodiment of the present invention incorporated in an inkjet recording apparatus.

FIG. 8 is a schematic diagram of a liquid-discharge-failure detecting apparatus according to a fourth embodiment of the present invention incorporated in an inkjet recording apparatus. The liquid-discharge-failure detecting apparatus includes a light-reflective member 22 such as a prism or a mirror. The light-reflective member 22 reflects the beam 15 to the inkjet head surface 11. In this configuration, the ink droplet 13 falls on the light-reflective member 22 instead of the collimating lens 16. This prevents staining of the collimating lens 16 and the light-emitting element 14. Moreover, the liquid-discharge-failure detecting apparatus can be made smaller because an optical path of the beam 15 is bent.

The light-reflective member 22 is moved in parallel with the nozzle array in a direction indicated by an arrow in FIG. 8. While the beam 15 moves in parallel with the nozzle array according to the move of the light-reflective member 22, the detecting process is performed on the nozzles n1, n2, . . . , nN, . . . , and nX one by one. In this manner, the liquid-discharge-failure detecting apparatus sequentially performs the detecting process on the nozzles n1, n2, n3, . . . , and nX. Alternatively, the liquid-discharge-failure detecting apparatus can be configured to move the inkjet head 10 instead of the light-reflective member 22.

Figure 9:
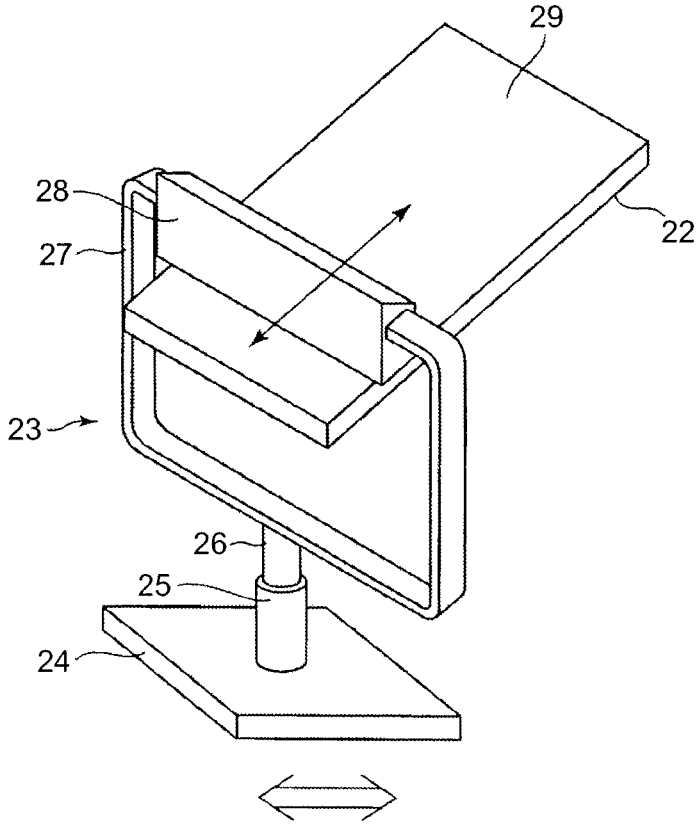
FIG. 9 is a schematic diagram of a light-reflective-member cleaning unit that cleans a light-reflective member shown in FIG. 8.

FIG. 9 is a schematic diagram of a light-reflective-member cleaning unit 23 that can be used to clean the light-reflective member 22. The light-reflective-member cleaning unit 23 includes a movable plate 24, a first supporting cylinder 25, a second supporting cylinder 26, a holder 27, and a blade 28. The movable plate 24 moves horizontally in directions of tilt of the light-reflective member 22. The first supporting cylinder 25 stands on the movable plate 24 and slidably supports the second supporting cylinder 26. The second supporting cylinder 26 supports the holder 27. The holder 27 is a rectangular frame that supports the blade 28. The blade 28 is made of rubber.

When the movable plate 24 moves in a direction indicated by a thick arrow in FIG. 9, the second supporting cylinder 26 slides up and down to move the blade 28 in the tilting direction of the light-reflective member 22, thereby the blade 28 slides on a tilted reflective surface 29 of the light-reflective member 22 to remove the ink droplet 13. In this manner, the light-reflective-member cleaning unit 23 cleans the tilted reflective surface 29, thereby preventing degradation of reflectance of the light-reflective member 22 due to the ink droplet 13 and retaining efficiency of the light-reflective member 22.

Instead of the blade 28 made of rubber, the light-reflective-member cleaning unit 23 can employ a porous material such as sponge, and the porous material can be soaked with cleaning solution. Moreover, instead of moving the whole light-reflective-member cleaning unit 23, the light-reflective-member cleaning unit 23 can be fixed so that a cleaning material like the rubber blade or the porous material slides on the tilted reflective surface 29 when the light-reflective member 22 moves for sequential detecting process. In this manner, the light-reflective member 22 is cleaned without spending extra time for cleaning.

Figure 10:
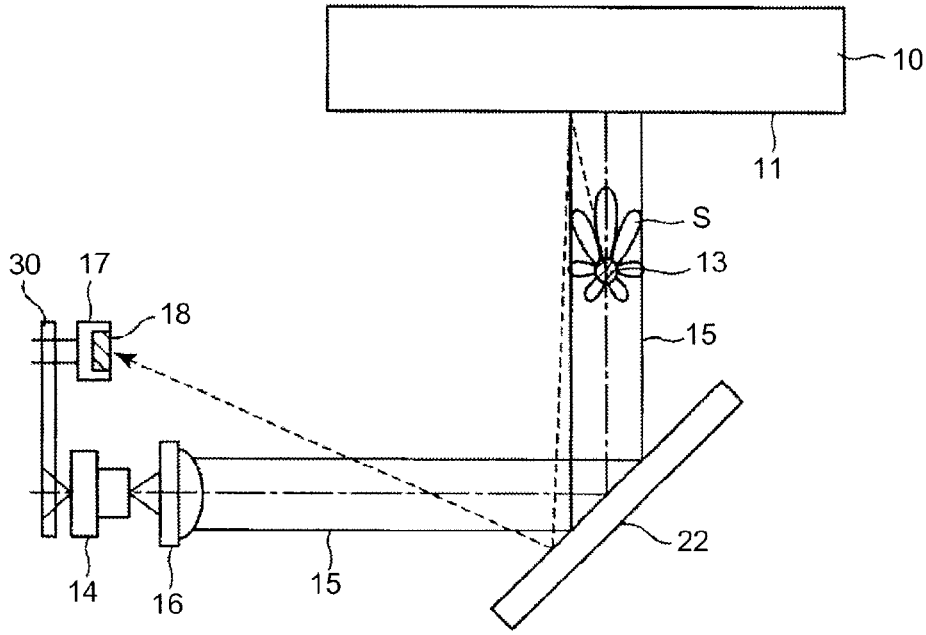
FIG. 10 is a schematic diagram of a liquid-discharge-failure detecting apparatus according to a fifth embodiment of the present invention incorporated in an inkjet recording apparatus.

FIG. 10 is a schematic diagram of a liquid-discharge-failure detecting apparatus according to a fifth embodiment of the present invention incorporated in an inkjet recording apparatus. According to the fifth embodiment, the light-emitting element 14 and the light-receiving element 17 are mounted to a single substrate. The forward-scattered light is reflected by the inkjet head surface 11, further reflected by the light-reflective member 22, and then received by the light-receiving surface 18 of the light-receiving element 17. In this manner, an electrical system including the light-emitting element 14 and the light-receiving element 17 is organized into one substrate.

Figure 11:
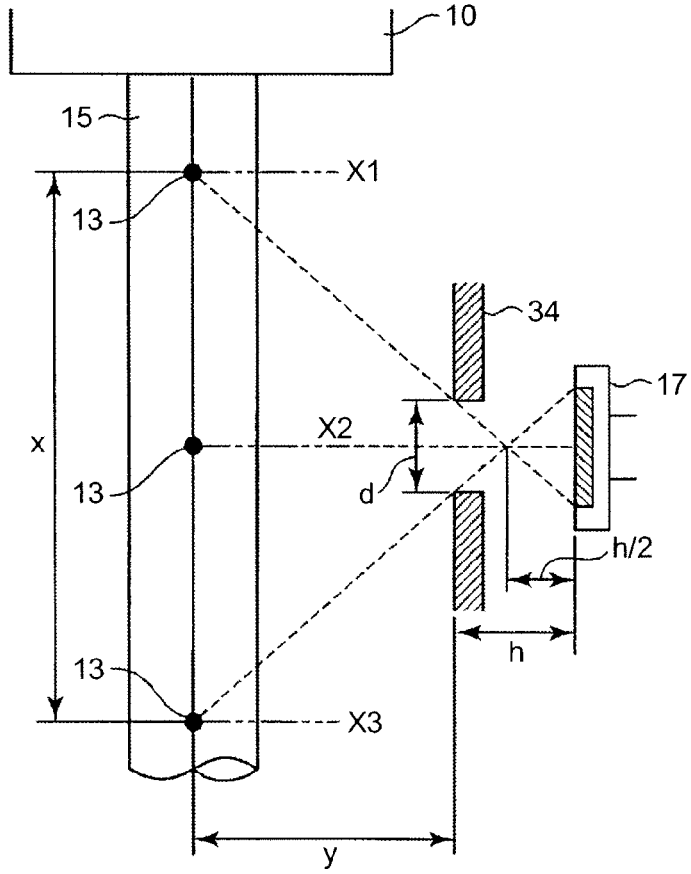
FIG. 11 is a schematic diagram of a liquid-discharge-failure detecting apparatus according to a sixth embodiment of the present invention incorporated in an inkjet recording apparatus.

FIG. 11 is a schematic diagram of a liquid-discharge-failure detecting apparatus according to a sixth embodiment of the present invention incorporated in an inkjet recording apparatus. The liquid-discharge-failure detecting apparatus further includes a shield plate 34 arranged in front of the light-receiving element 17 to limit a range of the forward-scattered light to be received by the light-receiving element 17. By limiting the range, a discharge speed V of the ink droplet 13 can be calculated. More specifically, by setting an opening length of the shield plate 34 d, a distance from the shield plate 34 to the beam 15 y, and a distance h from the shield plate 34 to the light-receiving element 17, a length x for which the forward-scattered light is received can be calculated. Based on a ratio $(y+h/2):(h/2)=x:d$, the length x is expressed as $x=d(2y+h)/h$.

Figure 12:
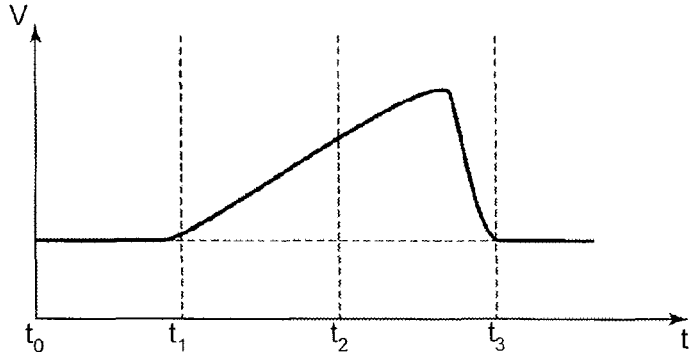
FIG. 12 is a graph of a waveform of the optical power received by the light-receiving element in the example shown in FIG. 11.

Assuming that the light-receiving element 17 receives optical power as plotted in a waveform shown in FIG. 12, a rise time of the waveform t1 corresponds to the point X1 and a fall time $t_3$ corresponds to the point X2. Therefore, the discharge speed V of the ink droplet 13 is calculated by $V=x/(t3-t1)$, or $V=d(2y+h)/h(t3-t1)$. By attaching a flange to the shield plate 34, the length x for which the forward-scattered light is received can be adjusted.

Figure 13:
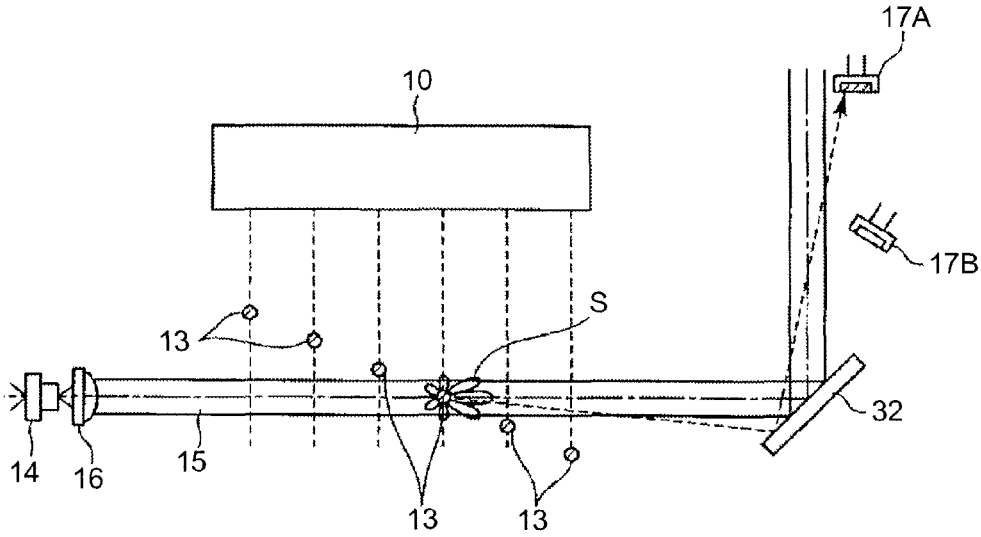
FIG. 13 is a schematic diagram for explaining how to perform a detecting process on a plurality of nozzles.

FIG. 13 is a schematic diagram for explaining how to perform the detecting process on the ink droplet 13 from the nozzles n1, n2, n3, . . . , and nX sequentially. As explained above, the parallel beam 15 is formed by the light-emitting element 14 and the collimating lens 16. The beam 15 is emitted in parallel with the nozzle array, it radiates onto a mirror 32, and the mirror 32 reflects the beam 15 upward. Two light-receiving elements 17A and 17B are arranged near the reflected beam 15.

The nozzles n1, n2, n3, . . . , and nX sequentially discharges the ink droplet 13 onto the beam 15 emitted from the light-emitting element 14. When the ink droplet 13 discharged from the nozzle nN is irradiated by the beam 15, the forward-scattered light is generated. The mirror 32 reflects the forward-scattered light and the light-receiving element 17A receives the reflected forward-scattered light, thereby performing the detecting process on the ink droplet 13 from each of the nozzles n1, n2, n3, . . . , and nX.

Figure 14:
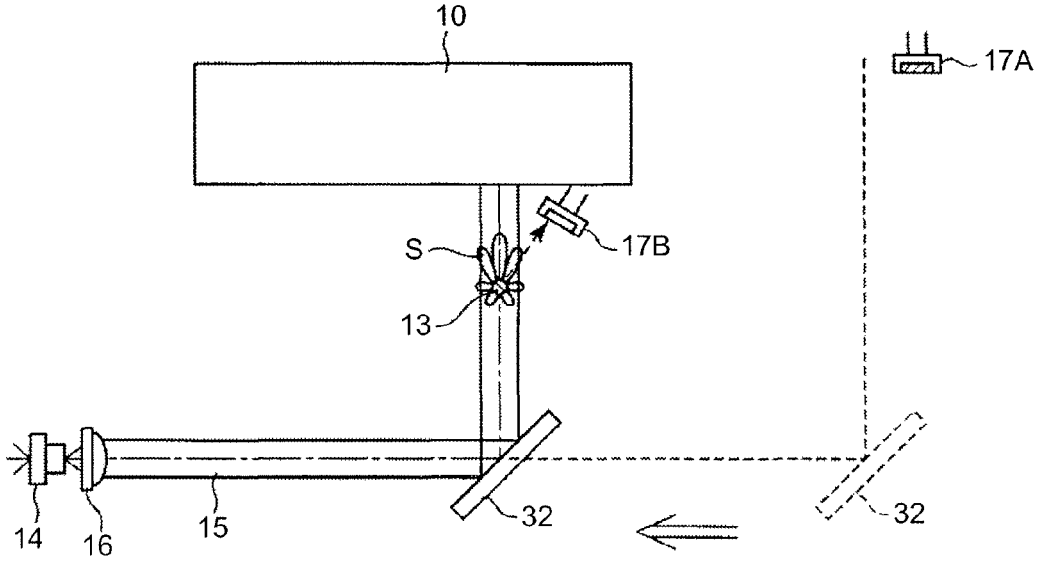
FIG. 14 is a schematic diagram for explaining how to perform a more precise detecting process on a suspicious nozzle by moving the reflective member when a failure is detected in the detecting process.

FIG. 14 is a schematic diagram for explaining how to perform a more precise detecting process on a suspicious nozzle by moving the mirror 32 when a failure is detected in the sequential detecting process on the nozzles n1, n2, n3, . . . , and nX.

When a failure is detected, the mirror 32 and the light-receiving element 17B move so that the beam 15 is reflected to the suspicious nozzle, and the suspicious nozzle discharges the ink droplet 13 for more precise measurement. The mirror 32 and the light-receiving element 17B are preferably integrated to omit a need of positioning the light-receiving element 17B. Moreover, with the light-reflective-member cleaning unit 23 that cleans a reflective surface of the mirror 32, the precise detecting process can be performed sequentially.

Figure 15:
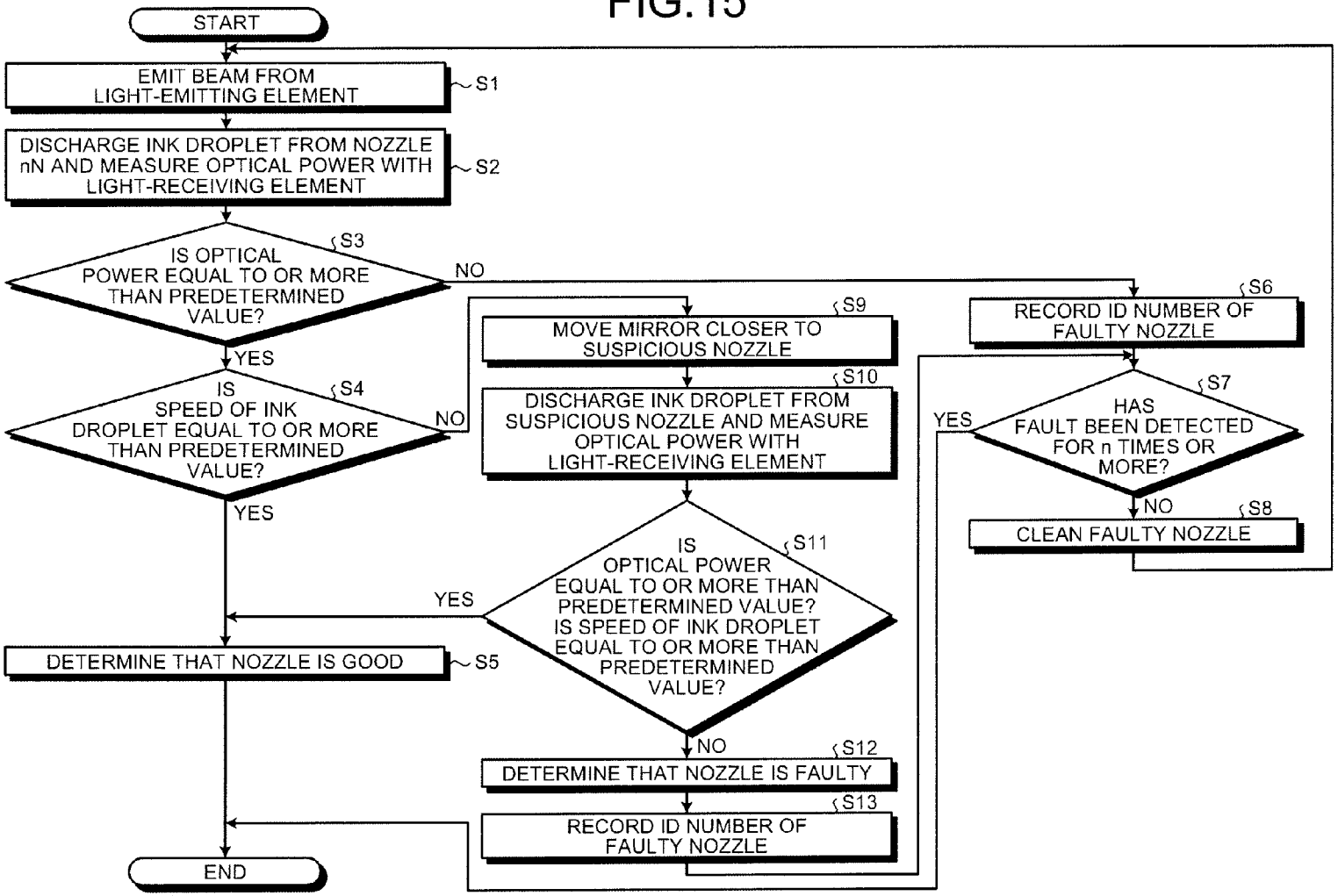
FIG. 15 is a flowchart of detecting process of a liquid discharge failure.

FIG. 15 is a flowchart of detecting process of a liquid discharge failure explained above. This flowchart depicts a detecting process of a liquid discharge failure for one nozzle, therefore, this flowchart is repeated for the all the nozzle.

The light-emitting element 14 emits the beam 15 (Step S1). The nozzle nN discharges the ink droplet 13, and the light-receiving element 17 measures the optical power of the forward-scattered light from the ink droplet 13 discharged from the nozzle nN (Step S2). Whether the optical power is equal to or more than a first value is determined (Step S3). When the optical power is equal to or more than the first value (YES at Step S3), whether speed of the ink droplet 13 is equal to or more than a second value is determined (Step 4). When the speed of the ink droplet 13 is equal to or more than the second value (YES at Step S4), it is determined that the nozzle nN is good (Step S5), and the detecting process on the nozzle nN ends.

When the optical power is less than the first value (NO at Step S3), an ID number of the nozzle nN is recorded as a faulty nozzle (Step S6) and whether the fault has been detected for n times or more is determined (Step S7). When the fault has been detected for less than n times (NO at Step S7), the nozzle nN is cleaned (Step S8) and the process returns to Step S1. When the fault has been detected for n times or more (YES at Step S7), the detecting process on the nozzle nN ends.

When the speed of the ink droplet 13 is less than the second value (NO at Step S4), the mirror 32 moves closer to the nozzle nN (Step S9). The nozzle nN discharges the ink droplet 13, and the light-receiving element 17 measures the optical power (Step S10). Whether the optical power is equal to or more than the first value is determined and whether the speed of the ink droplet 13 is equal to or more than the second value are determined (Step S11). When the optical power is equal to or more than the first value and also the speed of the ink droplet 13 is equal to or more than the second value (YES at Step S11), it is determined that the nozzle nN is good (Step S5), and the detecting process on the nozzle nN ends.

When the optical power is less than the first value or the speed of the ink droplet 13 is less than the predetermined value (NO at Step S11), it is determined that the nozzle nN is faulty (Step S12). The ID number of the nozzle nN is then recorded (Step S13), and whether the fault has been detected for n times or more is determined (Step S7). When the fault has been detected for less than n times (NO at Step S7), the nozzle nN is cleaned (Step S8) and the process returns to Step S1. When the fault has been detected for n times or more (YES at Step S7), the detecting process on the nozzle nN ends. The same procedure is then repeated for the other nozzles.

According to an aspect of the present invention, it is possible to provide a liquid-discharge-failure detecting apparatus that precisely detects a bending trace of a liquid discharged from a nozzle in any direction.

Furthermore, the liquid-discharge-failure detecting apparatus can sequentially perform a detecting process on a plurality of nozzles along a nozzle array.

Moreover, a light-receiving element can receive the optical power of the scattered light with a high SNR without being affected by optical power of a beam.

Furthermore, the light-receiving element can receive an intense forward-scattered light after being reflected by an inkjet head surface.

Moreover, by arranging the light-receiving element near the light-emitting element, an electrical system is organized into one substrate.

Furthermore, by using a clear liquid as a droplet, stains by scattered droplets can be prevented.

Moreover, by using a cleaning solution as a droplet, the stains by scattered droplets can be more efficiently prevented.

Furthermore, a light-transmissive member can protect the light-emitting element from stains by an ink droplet without interrupting a detecting process.

Moreover, the light-transmissive member can be tilted so that the ink droplet on the light-transmissive member flows down by gravity and automatically falls into a waste tank or the like to keep the light-transmissive member clean.

Furthermore, with a light-reflective member that reflects the beam from the light-emitting element to the inkjet head surface, the light-emitting element can be prevented from being stained by the ink droplet and the size of the liquid-discharge-failure detecting apparatus can be small because an optical path of the beam is bent.

Moreover, a light-reflective-member cleaning unit that cleans the light-reflective member prevents degradation of reflectance of the light-reflective member due to the ink droplet and retains efficiency of the light-reflective member.

Furthermore, by moving the beam in parallel with the nozzle array according to the move of the light-reflective member, the liquid-discharge-failure detecting apparatus can sequentially perform the detecting process on the nozzles.

Moreover, with a shield plate arranged in front of the light-receiving element to limit a range of the forward-scattered light received by the light-receiving element, a discharge speed of the ink droplet can be calculated.

Furthermore, it is possible to provide an inkjet recording apparatus including a liquid-discharge-failure detecting apparatus that precisely detects a bending trace of a liquid discharged from a nozzle in any direction based on decrease of the optical power of the scattered light received by a light-receiving element.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid-discharge-failure detecting apparatus that detects a liquid discharge failure of a nozzle being arranged on an inkjet head surface and discharging droplets of a liquid, the liquid-discharge-failure detecting apparatus comprising:

a light-emitting element that emits a beam onto a droplet discharged from the nozzle from a direction opposite to a direction of discharge of the droplet;

a light-receiving element that receives a scattered light generated by scattering of the beam by the droplet;

a failure detecting unit that detects the liquid discharge failure from data of the scattered light received by the light-receiving element; and wherein the light-receiving element is arranged off from the beam.

2. The liquid-discharge-failure detecting apparatus according to claim 1, wherein a plurality of nozzles are arranged to form a one-dimensional nozzle array along the inkjet head surface, the liquid-discharge-failure detecting apparatus further comprising:

the light-emitting element configured to move with respect to the inkjet head surface in parallel with the nozzle array.

3. The liquid-discharge-failure detecting apparatus according to claim 1, wherein the light-receiving element is arranged with a light-receiving surface thereof facing in a direction of discharge of the droplet.

4. The liquid-discharge-failure detecting apparatus according to claim 1, wherein the light-receiving element is arranged with a light-receiving surface thereof facing the inkjet head surface.

5. The liquid-discharge-failure detecting apparatus according to claim 1, wherein the light-receiving element is arranged near the light-emitting element.

6. The liquid-discharge-failure detecting apparatus according to claim 1, wherein the nozzle is configured to discharge a clear liquid.

7. The liquid-discharge-failure detecting apparatus according to claim 1, wherein the nozzle is configured to discharge a cleaning solution.

8. The liquid-discharge-failure detecting apparatus according to claim 1, wherein the nozzle is configured to discharge ink.

9. The liquid-discharge-failure detecting apparatus according to claim 1, further comprising a light-transmissive member that is arranged between the inkjet head surface and the light-emitting element and that allows passage of the beam emitted by the light-emitting element.

10. The liquid-discharge-failure detecting apparatus according to claim 9, wherein the light-transmissive member is tilted.

11. The liquid-discharge-failure detecting apparatus according to claim 1, further comprising a light-reflective member that reflects the beam from the light-emitting element to the inkjet head surface.

12. The liquid-discharge-failure detecting apparatus according to claim 11, further comprising a light-reflective-member cleaning unit that cleans the light-reflective member.

13. The liquid-discharge-failure detecting apparatus according to claim 11, wherein a plurality of nozzles are arranged to form a one-dimensional nozzle array along the inkjet head surface, and the liquid-discharge-failure detecting apparatus further comprising a light-reflective-member configured to move in parallel with the nozzle array.

14. The liquid-discharge-failure detecting apparatus according to claim 1, further comprising a shield plate that is arranged in front of the light-receiving element and that limits a range of the scattered light to be received by the light-receiving element.

15. An inkjet recording apparatus including a liquid-discharge-failure detecting apparatus that detects a liquid discharge failure of a nozzle being arranged on an inkjet head surface and discharging droplets of a liquid, the liquid-discharge-failure detecting apparatus comprising:

a light-emitting element that emits a beam onto a droplet discharged from the nozzle from a direction opposite to a direction of discharge of the droplet;

a light-receiving element that receives a scattered light generated by scattering of the beam by the droplet;

a failure detecting unit that detects the liquid discharge failure from data of the scattered light received by the light-receiving element; and wherein the light-receiving element is arranged off from the beam.

* * * * *